US005582401A

United States Patent [19]

Malone et al.

[11] Patent Number: 5,582,401

[45] Date of Patent: Dec. 10, 1996

[54] PLAY-PREVENTING BASKETBALL HOOP CLOSURE

[76] Inventors: Terrence W. Malone, 3110 N. 76th Av., Elmwood Park, Ill. 60635; Kathryn J. Godlewski, 915 N. York Rd., Elmhurst, Ill. 60126

[21] Appl. No.: 376,938

[22] Filed: Jan. 23, 1995

[51] Int. Cl.[6] ..... A63B 63/08; E05B 65/00

[52] U.S. Cl. ..... 273/1.5 R; 70/57

[58] Field of Search ..... 273/1.5 R, 1.5 A; 70/14, 57, 209, 226; 244/224

[56] References Cited

U.S. PATENT DOCUMENTS

| | | | |
|---|---|---|---|
| 3,173,687 | 3/1965 | Hair | 273/1.5 A |
| 3,348,840 | 10/1967 | Dix | 273/1.5 A |
| 3,910,574 | 10/1975 | Voltz et al. | 273/1.5 A |
| 5,338,026 | 8/1994 | Kregel | 273/1.5 R X |
| 5,433,095 | 7/1995 | Mitchell et al. | 273/1.5 R X |
| 5,439,210 | 8/1995 | Davis | 273/1.5 R |

*Primary Examiner*—William H. Grieb
*Attorney, Agent, or Firm*—Franas C. Kowalik

[57] ABSTRACT

A basketball hoop closure adapted to be emplaced from the ground by means of a removable rod-like installation member, wherein the installation member is adapted to alternately raise or lower the closure and drive or remove fasteners associated with hoop engaging forcipate ends of the closure.

14 Claims, 1 Drawing Sheet

PLAY-PREVENTING BASKETBALL HOOP CLOSURE

BACKGROUND OF THE INVENTION

The instant invention is directed to a means for closing off a basketball hoop so as to prevent the hoop from being used in play.

Conventionally, to prevent the play of the game in an area where a hoop or basket was installed required a person to climb a ladder and install a chain and lock equatorially across the aperture of the basket or to fabricate a plate or board to close off the aforementioned aperture and then install same while perched atop a ladder or to remove the hoop entirely.

DISCUSSION OF THE PRIOR ART

U.S. Pat. No. 5,338,026 to Kregel describes a physical training unit comprising a ball attached to a tether which is suspended from a mounting plate which is hung over the ring of the hoop.

U.S. Pat. No. 3,910,574 to Voltz et al. is a basketball rebound training device which comprises a membrane spanning the aperture to the hoop and containing therein a plurality of objects intented to distort the membrane so as to reduce the certainty of the path of a basketball that had impacted on the membrane.

U.S. Pat. No. 3,348,840 to Dix comprises a resiliently mounted ring which is placed within the hoop aperture. The ring as with the above recited Voltz patent is designed as a means for practicing rebounds.

U.S. Pat. No. 3,173,687 to Hair comprises a plurality of radially arranged spokes clipped over the hoop ring and designed to provide a rebounding surface for players to use to practice retrieving a rebounded ball.

OBJECT OF THE INVENTION

It is the primary object of the invention to provide a means for closing off a basketball hoop from play.

It is a further object of the invention to provide a means for closing off a basketball hoop from play without the necessity of climbing up to the level of the hoop.

It is another object of the invention to provide a means for closing off a basketball hoop from play that is easily and quickly installed.

It is another object of the invention to provide a means for closing off a basketball hoop from play which, while easily removed by the installer, is difficult to remove by some other individual.

These and other objects of the invention will become apparent from the specification, drawings and claims herein.

DETAILED DESCRIPTION OF THE INVENTION

Figure 1:
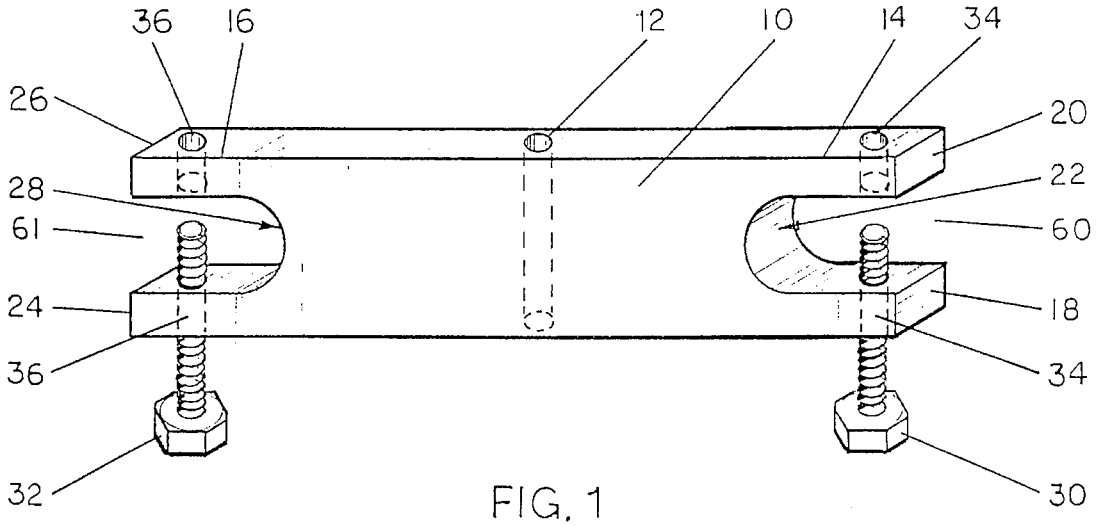
FIG. 1 is a perspective view of the novel closure.
Figure 2:
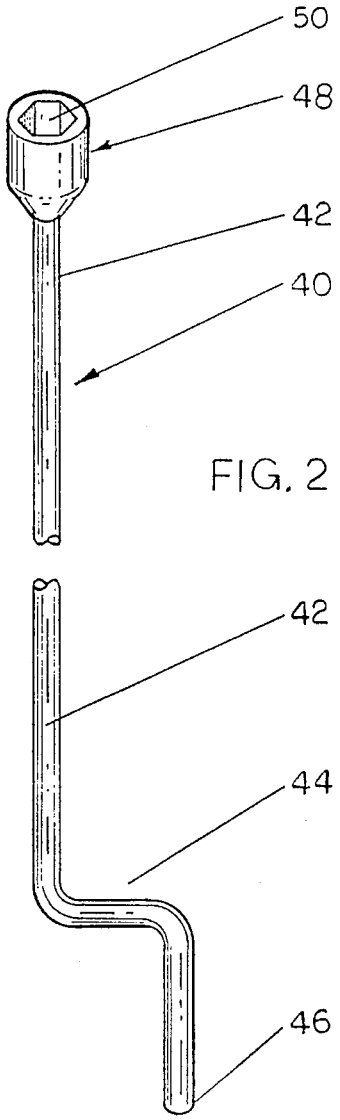
FIG. 2 is a perspective view of the installation apparatus.
Figure 3:
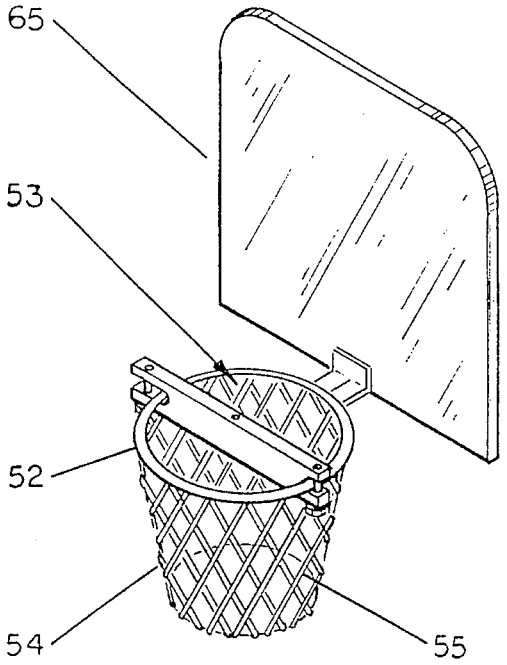
FIG. 3 is a perspective view of the closure installed on a basketball hoop.

Referring to the drawings, the novel basketball closure wherein the body may be made of either a metal or a plastic such as polypropylene or an UHMW. This body (10) defines a central axial port (12) which extends through the body along the transverse axis through the thicker aspect of the body.

The closure body 10 further consists of a plurality of forcipate ends 14, 16 defining a body longitudinal axis therebetween wherein the proximal forcipate end 14 further comprises a first plurality of tines 18, 20 which define a first groove 22 therebetween, and the distal forcipate end 16 also further consists of a second plurality of tines 24, 26 which define a second groove 28 therebetween.

Transverse to the respective forcipate ends are fastening means 30,32 for attaching the body 10 wherein in the preferred embodiment the fastening means are threaded fasteners which pass through co-axial holes 34,36 defined by the tines 18, 20 and 24, 26 wherein each hole set defined thereby is threaded in a first (lower) tine 18, 24 and unthreaded in a second (upper) tine 20, 26, thereby allowing a threaded fastener to be inserted across the respective forcipate end 14, 16 and, therefore, bridge from tine to tine the respective groove 22, 28 theredefined.

Associated with the closure body 10 and intermittently attached thereto, is an installation means 40. The installation means comprises a substantially rod-like appendage 42 onto which is impressed a crank-like FIG. 44 at the rod-like appendage's distal end 46.

At the proximal end 48 of the appendage 42 is a fastener actuating means 50 which is adapted to engage the fastening means 30, 32 so as, when actuated, inducing the fastening means to either close off the grooves 22, 28 or, conversely, to remove the fastening means 30, 32 from across the grooves 22, 28.

In operation, the body 10 of the instant invention is first attached to the installation means 40 by inserting the distal end 46 of the installation means 40 into the central axial port 12 of the body 10 which rides up appendage 42 until the body 10 reaches the crank-like FIG. 44 and rests thereon. At this time, the fastening means 30, 32 are withdrawn from across respective grooves 22, 28. Using the attachment means 40, the operator raises the body 10 and sequentially engages the basketball hoop 52-into each of the grooves 22, 28 in the respective forcipate ends 14, 16 of the body 10. In this installed configuration, the net 54 can either be engaged by the body 10 by engaging net elements 55 within the grooves 22, 28 so as to prevent theft of the net 54, or the body 10 can be installed on the hoop element 52 solely.

When in engagement, the hoop body 52 is resting within each of the respective grooves 22, 28 interiorly to each of the respective fastening means 30, 32, with the body 10 across the hoop aperture 53.

Once the body 10 is engaged with the hoop 52, the attachment means 40 is withdrawn from the central axial port 12. The operator then inverts the installation means 40 and, using the fastener actuating means 50 on the proximal end 48 of the rod-like appendage 42 of the installation means 40 raises the proximal end 48 and brings fastener actuating means 50 into engagement with either one of the respective fastening means 30, 32 and by actuating the fastener actuating means 50 sequentially drives the fastening means 30, 32 across the groove apertures 60, 61 exterior to the hoop body 52. In this configuration, the body 10 is securely attached across the hoop aperture 53 and since the hoop aperture 53 will no longer pass a basketball, the hoop assembly 65 is removed from play.

To restore the hoop assembly 65 to use in play, the operator merely engages the fastener actuating means 50 with either one of the fastening means 30 or 32 and sequentially withdraws the fastening means 30, 32 from across their respective groove apertures 60, 61. The operator then inverts the installation means 40 and using the distal end 46 of the rod-like appendage 42 inserts same into the axial port 12 of the body 10 and disengages the respective grooves 22, 28 from the hoop 52 and using the installation means 40 lowers the body 10 to the ground, thereby returning the hoop to play.

In accordance with our invention we claim:

1. For a basketball hoop assembly wherein said assembly includes a hoop defining an aperture therein, a closure for removing said hoop from use comprising a unitary, continuous aperture spanning body having a longitudinal axis, a distal end and a proximal end wherein said distal and proximal ends are forcipate and extend along the longitudinal axis of the body; said forcipate ends being adapted to engage said hoop with said body positioned across said aperture, and said distal and proximal forcipate ends further having associated therewith means for fastening said body to said hoop.

2. The invention according to claim 1 and said body having a transverse axis and said body further defining a central axial aperture along said axis, a means for installing said body in said hoop aperture said central axial aperture adapted to receive said installing means.

3. The invention according to claim 2 and said installing means comprising an appendage of rod-like aspect, said appendage having a distal end, wherein said appendage is adapted to raise said body to said hoop and maneuver said body into engagement with said hoop.

4. The invention according to claim 3 and said installing means further comprising a crank-like deformation of said rod-like appendage at said distal appendage end wherein said deformation facilitates installation of said body by holding said body at said distal end.

5. The invention according to claim 2 and said installing means comprising an appendage of rod-like aspect, said appendage having a proximal end, said proximal end having associated therewith a fastener actuating means for emplacing and removing said fasteners from across said grooves.

6. The invention according to claim 1 and said forcipate ends further comprising a plurality of tines associated with each such end, and said tines defining a groove therebetween, said groove adapted to be engaged by said hoop.

7. The invention according to claim 6 and fastening means associated with said tines wherein said fastening means are adapted to bridge said groove between said tines exterior to said hoop when said body is engaged therewith.

8. A method for removing a basketball hoop, having an aperture, from play, said method comprising:

1) emplacing a closure body upon an installation means;

2) raising said closure body to said hoop;

3) wherein said closure body has ends engageable with said hoop engaging said ends with said hoop;

4) withdrawing said installation means from said closure body leaving said closure body engaged with said hoop across said aperture;

5) wherein said body has a plurality of fastening means for attaching said body to said hoop associated with said engageable ends, and said installation means includes a means for actuating said fastening means, positioning said actuating means so as to actuate said fastening means;

6) actuating said fastening means and;

7) withdrawing said installation means from said fastening means; and the inverse of the method herein described effective to remove said body from said hoop aperture.

9. A closure for a basketball hoop having an aperture, said closure comprising:

a closure body adapted to engage said hoop while within said aperture, said closure body further comprising a distal forcipate end and a proximal forcipate end wherein each of said forcipate ends defines a groove and tines, a threaded fastener associated with each end of said body positioned to be driven across said groove, whereby said tines include an upper tine and a lower fine at each end of said body and each said lower tine is threaded to engage said fastener and each said upper tine is drilled to accept said fastener, and said body defining a central aperture, and an installation rod adapted to slidingly fit within said aperture, said installation rod including a stop means for preventing said body from sliding down said rod and said rod further comprising a drive means for driving said threaded fasteners wherein said rod has opposite ends and said stop means and said drive means are at said opposite ends.

10. The invention according to claim 9 and said body being made of UHMW plastic.

11. The invention according to claim 9 and said body being made of polypropylene.

12. The invention according to claim 9 and said stop means comprising an offset impressed upon said rod.

13. The invention according to claim 12 and said drive means comprising a socket adapted to engage said fasteners wherein said fasteners have heads.

14. The invention according to claim 13 and said offset operative to rotate said rod to rotate said socket.

* * * * *